US006679244B1

(12) United States Patent
Tsao

(10) Patent No.: US 6,679,244 B1
(45) Date of Patent: Jan. 20, 2004

(54) STRUCTURALLY IMPROVED STONE CUTTER

(76) Inventor: Wen-Hai Tsao, P.O. Box 697, Feng-Yuan City, Taichung Hsien (TW), 420

( * ) Notice: Subject to any disclaimer, the term of this patent is extended or adjusted under 35 U.S.C. 154(b) by 0 days.

(21) Appl. No.: 10/292,424

(22) Filed: Nov. 13, 2002

(51) Int. Cl.[7] ..... B28D 1/04
(52) U.S. Cl. ..... 125/13.01; 125/35; 451/360
(58) Field of Search ..... 451/360–361, 451/411, 488, 454; 125/13.01–13.03, 14, 35

(56) References Cited

U.S. PATENT DOCUMENTS 5,676,124 A * 10/1997 Lee ..... 125/13.01
5,746,193 A * 5/1998 Swan ..... 125/13.03
6,000,387 A * 12/1999 Lee ..... 125/13.01
6,263,866 B1 * 7/2001 Tsao ..... 125/13.01
6,439,218 B1 * 8/2002 Hulett ..... 125/13.01
6,494,198 B1 * 12/2002 Chen ..... 125/13.01

* cited by examiner

*Primary Examiner*—Eileen P. Morgan

(57) ABSTRACT

A structurally improved stone cutter including a rectangular frame supported by a foldable stand, a rectangular sink in the frame, a rectangular platform having sliding devices on two end slidably engaged with a pair of guide rods of the frame, a brace secured to a corner of the frame for supporting a positioning plate on the top, a motor positioned on a top having a first wheel on one end, a tubular shaft releasably secured to an underside of the positioning plate opposite to the motor and having a spindle therein supported by bearings, a second wheel secured to one end of spindle, a fan cap and a saw blade secured to the other end of the spindle, a belt tensely wrapped on the first and second wheels, a blade guard positioned on the top of the saw blade and secured on one end to an outer lateral surface of the positioning plate and a working station having a L-shaped edge releasably engaged into the gap of the frame.

1 Claim, 10 Drawing Sheets

STRUCTURALLY IMPROVED STONE CUTTER

BACKGROUND OF THE INVENTION

The present invention relates to stone cutters and more particularly to a structurally improved stone cutter.

As we know that the stone cutter is an indispensable tool to the architectural and civil engineering workers. A prior art stone cutter of mine, U.S. Pat. No. 6,263,866B1 (as shown in FIGS. 1, 2 and 3) comprises generally a sink 11, a frame 12, a platform 13, a motor 14 and a saw blade 15. The frame 12 has a rectangular body including a guide rod 121 and a rail plate 122. The platform 13 has a tubular slider 131 on underside and a L-shaped positioning plate 132. The tubular slider 131 has a pair of annular caps 1311 each of which has a plurality of longitudinal stripes 1313 on inner periphery for improving the smooth sliding of the tubular slider 131. The motor is disposed in a housing 16 and has an axis to actuate the saw blade 15 which is protected by a releasable casing 17. Although this type of annular caps 1311 has an advantage to facilitate the smooth sliding of the platform 13. However, due to the tightly sealed tubular slider 131, the air inside the tubular slider 131 will cause a transient resistant force to the sliding movement. Besides, the prior art stone cutter fixes its power transmission shaft in a casing which causes difficult to change the bearings therein and has poor radiation. Further, the tools and material has no place to put. These problems need to be solved.

SUMMARY OF THE PRESENT INVENTION

The present invention has a main object to provide a structurally improved stone cutter in which there is no transient resistant force to obstruct the smooth sliding of the platform.

Another object of the present invention is to provide a structurally improved stone cutter in which the tubular shaft is readily to assemble or disassemble and the bearings therein are easy to be replaced.

Still another object of the present invention is to provide a structurally improved stone cutter in which a fan cap has a fan therein to provide a good radiation function.

Further object of the provide invention is to provide a structurally improved stone cutter which has a working station to facilitate the placing of tools and raw materials.

The present invention will become more fully understood by reference to the following detailed description thereof when read in conjunction with the attached drawings.

DETAILED DESCRIPTION OF THE PREFERRED EMBODIMENT

Figure 1:
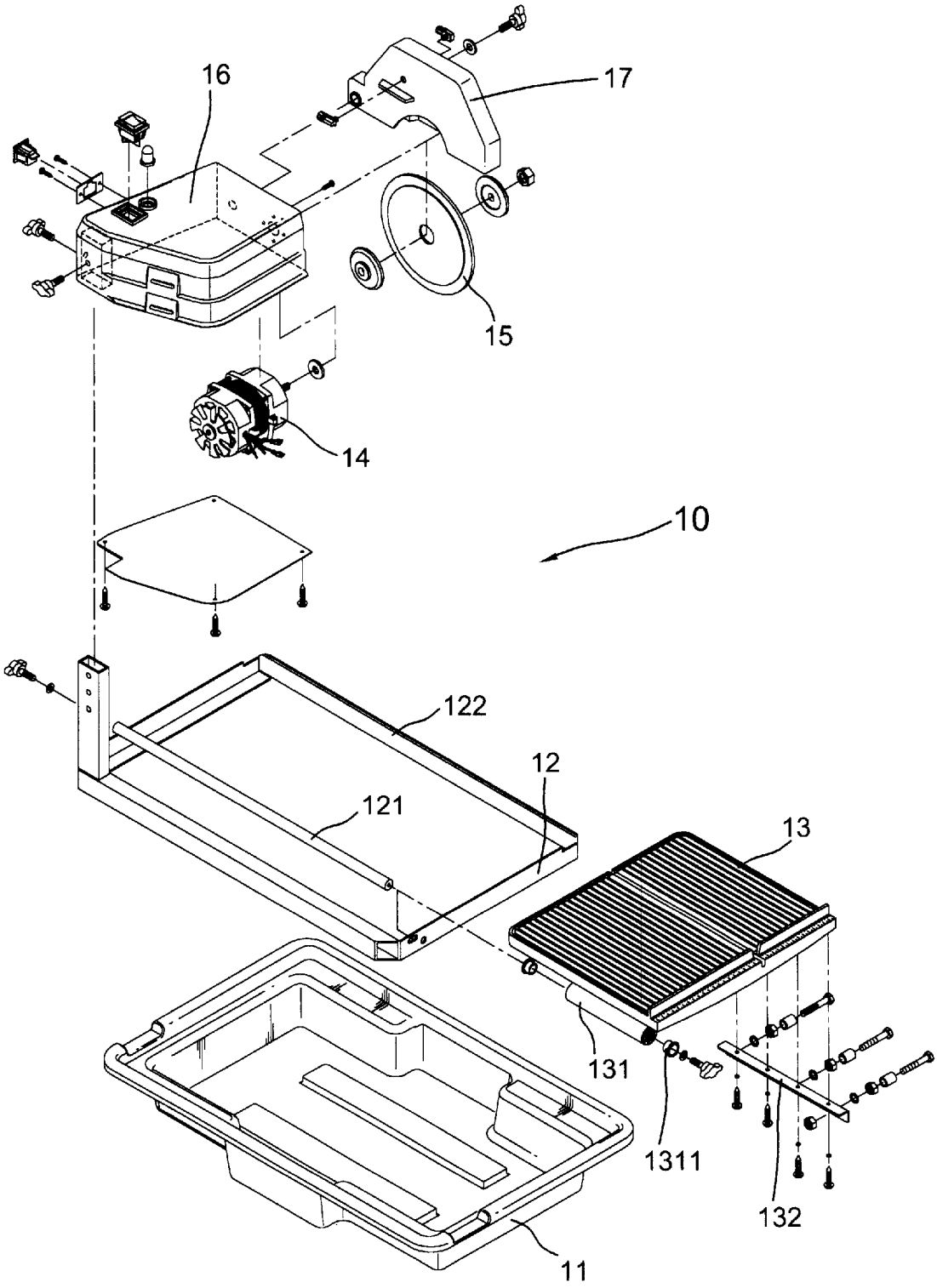
FIG.1 Prior Art
FIG. 1 is an exploded perspective view to show a stone cutter of a prior art (U.S. Pat. No. 6,263,866B1)
Figure 2:
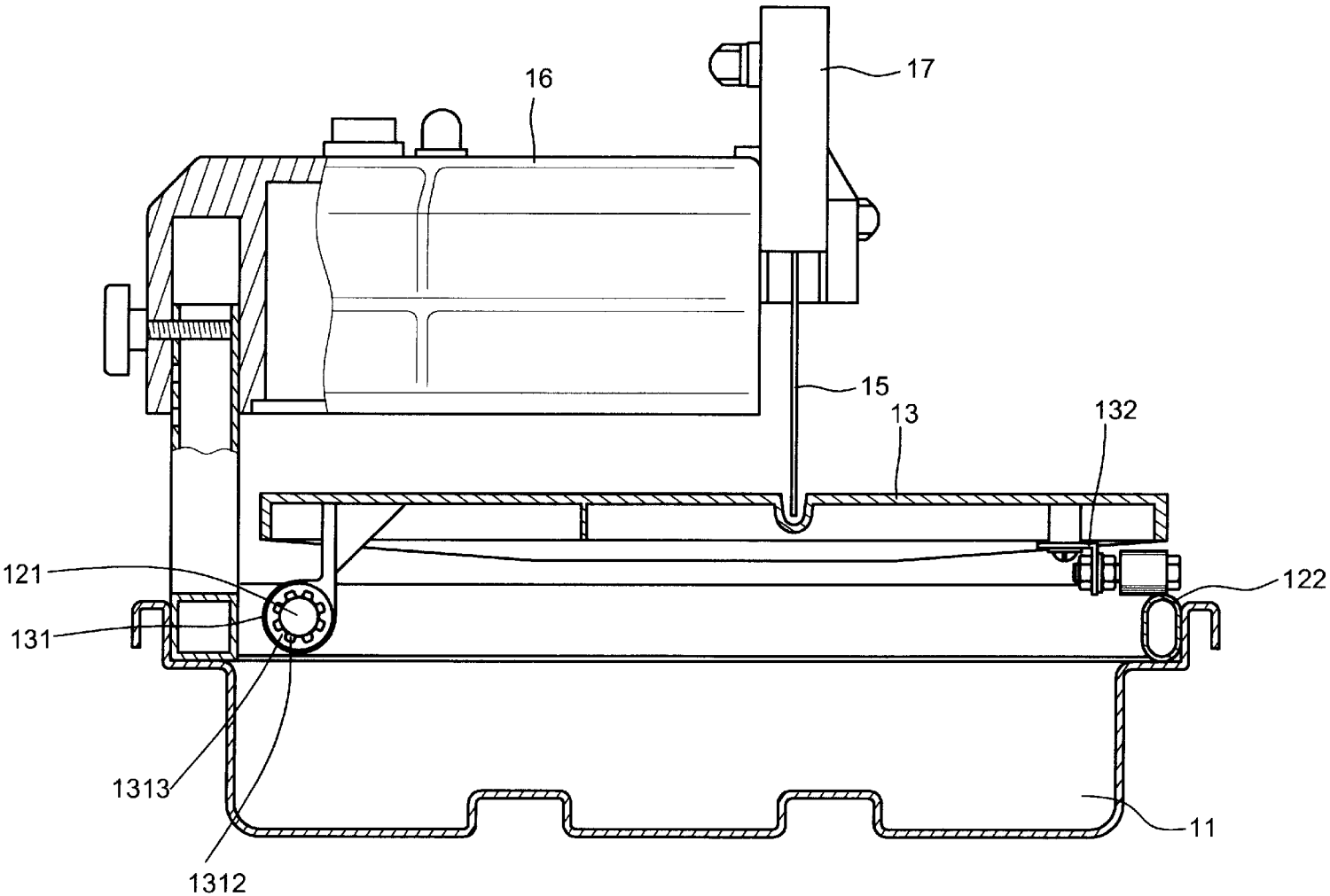
FIG.2 Prior Art
FIG. 2 is an elevational view with partially section to show the assembly of FIG. 1.
Figure 3:
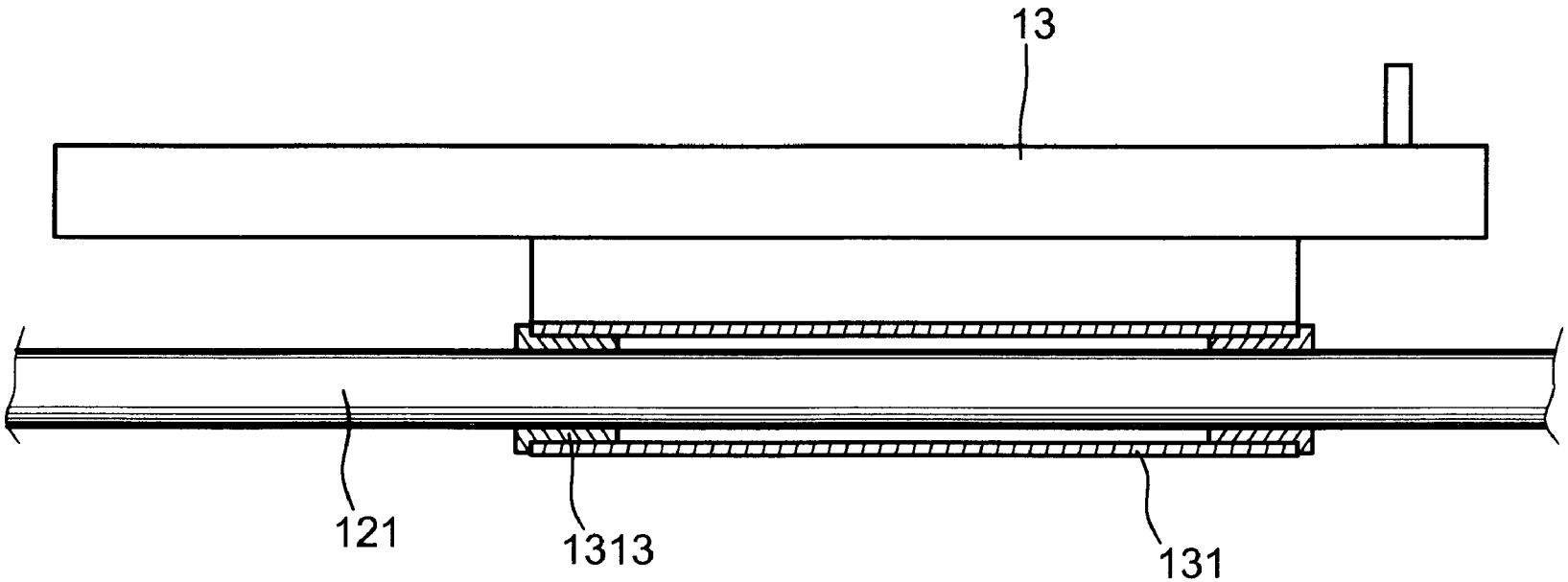
FIG.3 Prior Art
FIG. 3 is a sectional view to show the tubular slider of FIG. 1.
Figure 4:
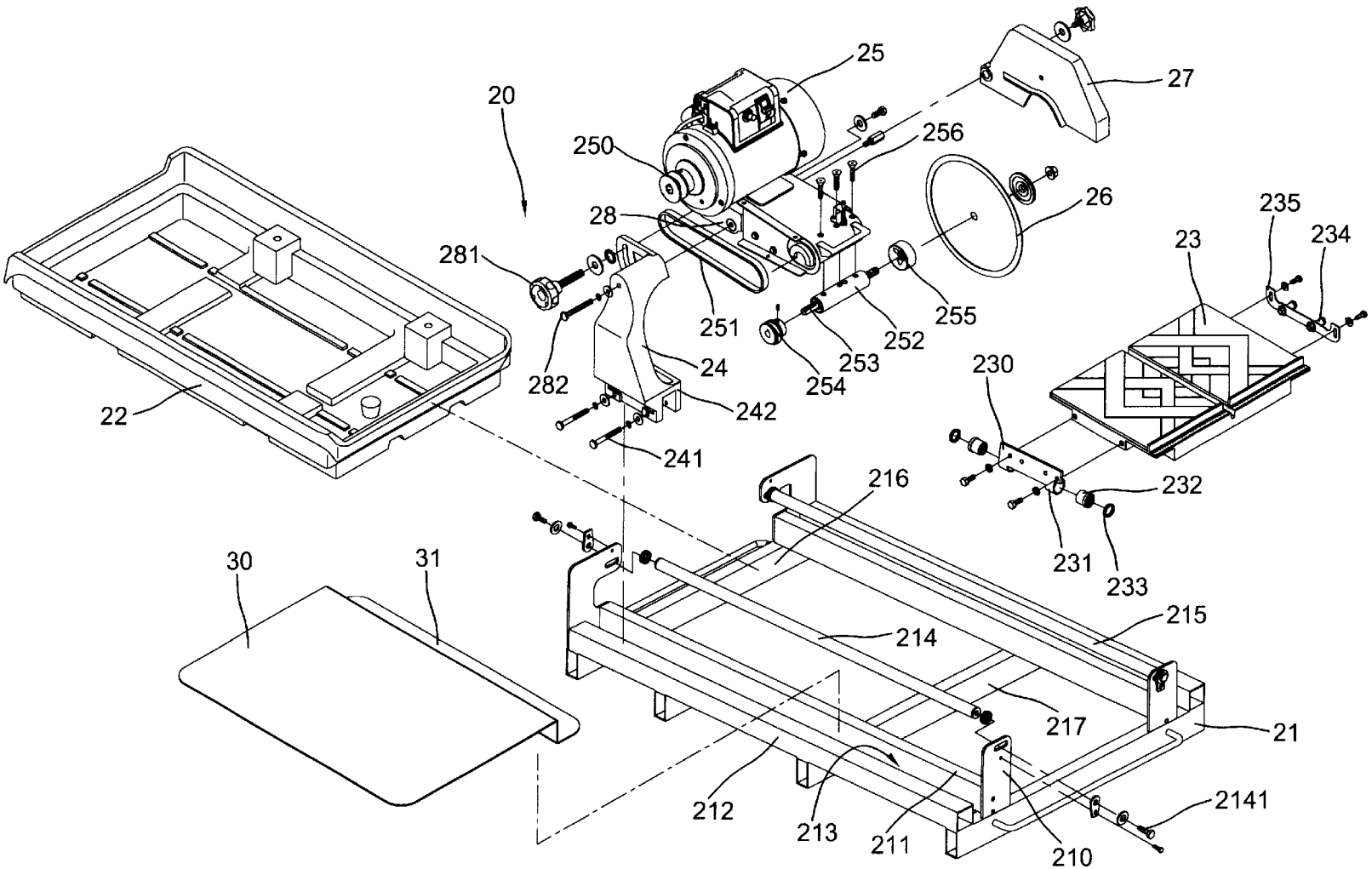
FIG. 4 is an exploded perspective view to show a stone cutter of the preferred embodiment of the present invention.
Figure 5:
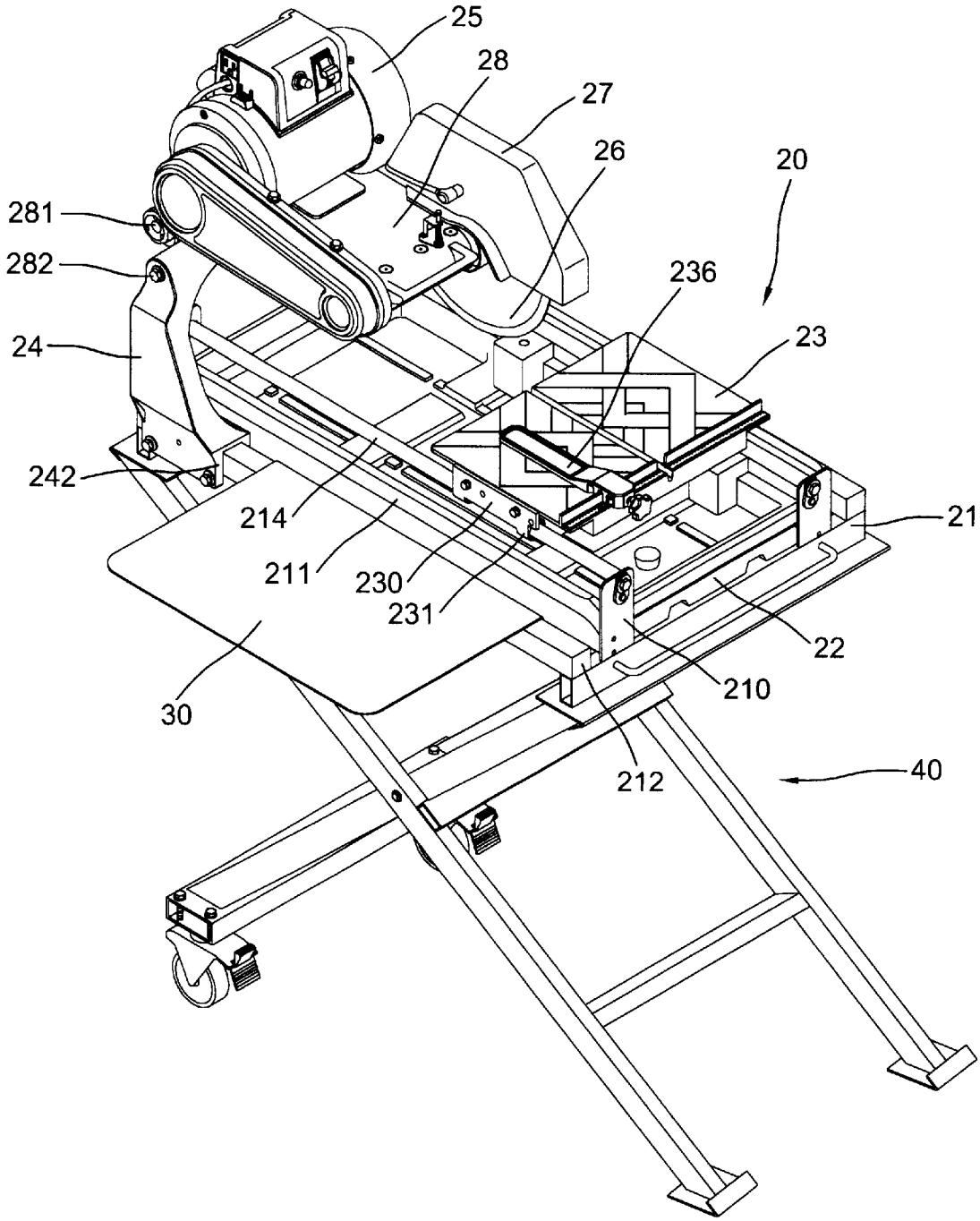
FIG. 5 is a perspective view to show the assembly of FIG. 4.

Referring to the drawings and initiated from FIGS. 4 and 5, the structurally improved stone cutter 20 of the present invention comprises generally a rectangular frame 21, a rectangular sink 22, a rectangular platform 23 a brace 24, a motor 25, a saw blade 26 and an upper blade guard 27.

Figure 11:
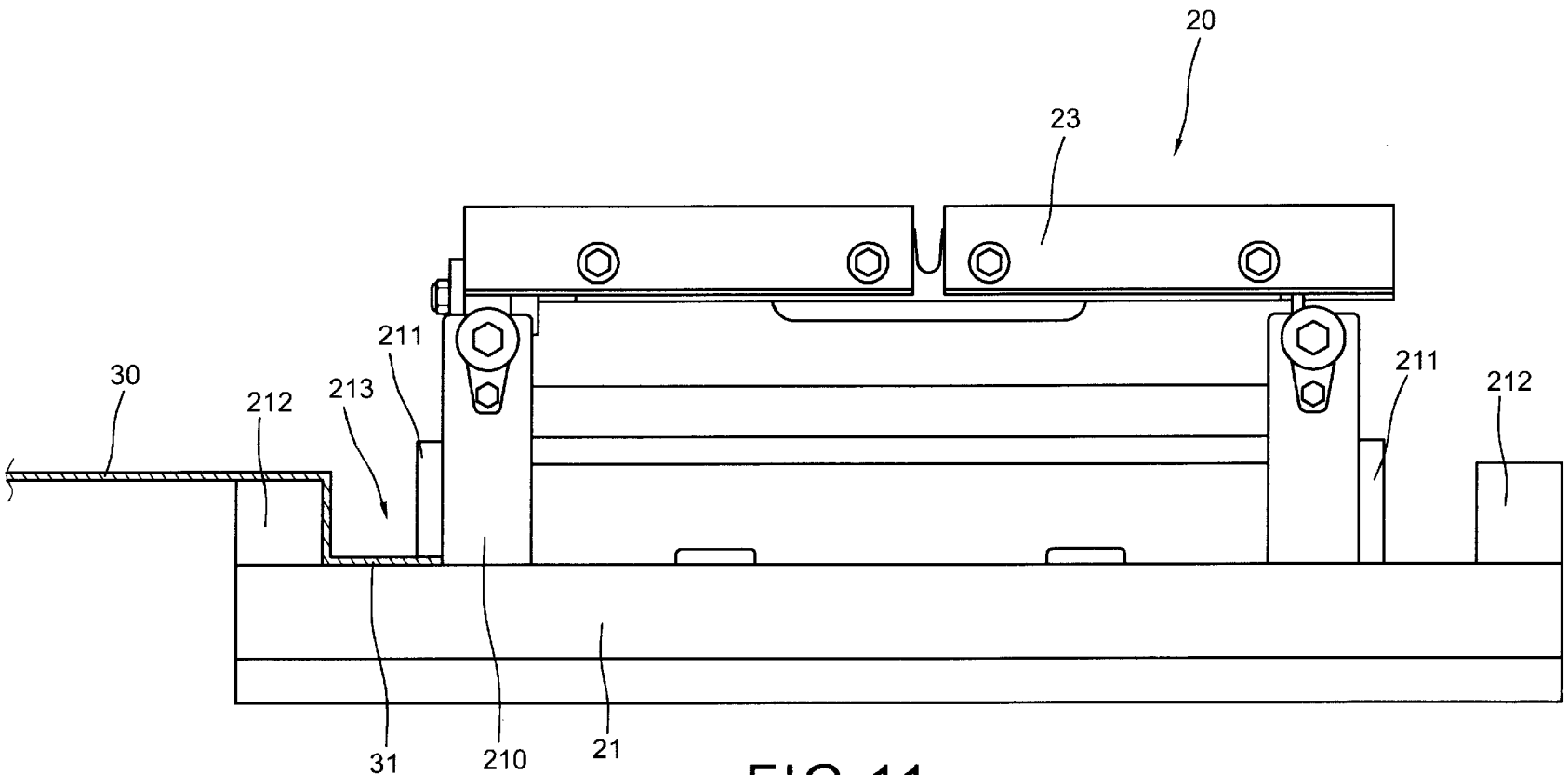
FIG. 11 is an elevational view with partially sectional view to show a working station disposed in a gap of a frame.

The rectangular frame 21 is combined with two pairs of longitudinal bars 211 and 212 and a plurality of transverse bars 216 and 217 and has a pair of gaps 213 defined between the longitudinal bars 211 and 212 for disposing a working station 30 which has a L-shaped edge 31 on an inner edge releasably engaged into the gap 213 (as shown in FIGS. 5 and 11) and is provide to put tools and raw materials during the operation, four protrudent plates 210 spacedly projected upward from abutting four corners of the frame 21 for respectively securing two ends of a pair of guide rods 214 and 215 by screws 2141 and washers.

The rectangular sink 22 is disposed into the rectangular frame 21.

A foldable stand 40 supports the rectangular frame 21 (as shown in FIG. 5).

Figure 6:
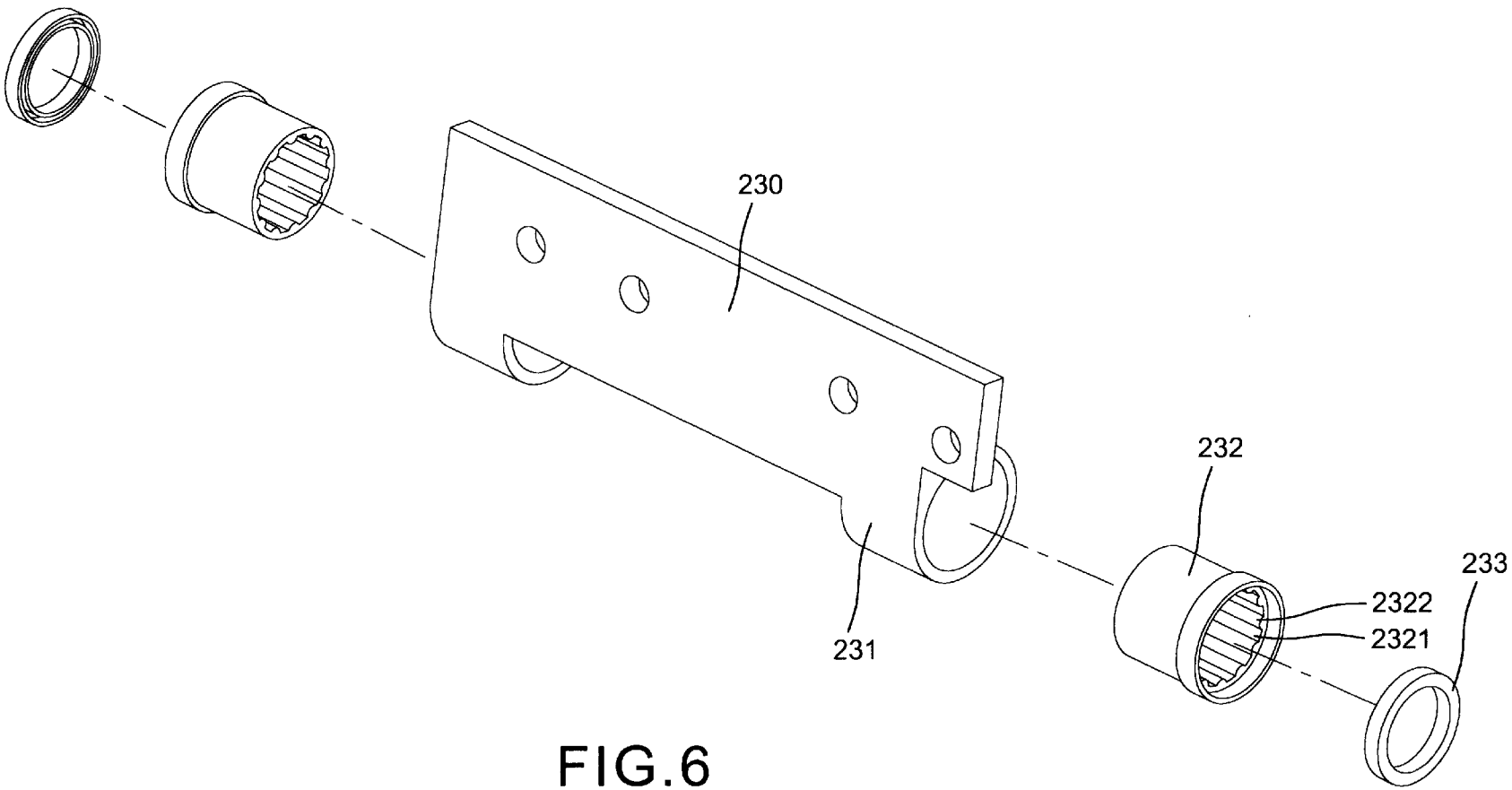
FIG. 6 is an exploded perspective view to show the sliding plate and its annular caps.
Figure 7:
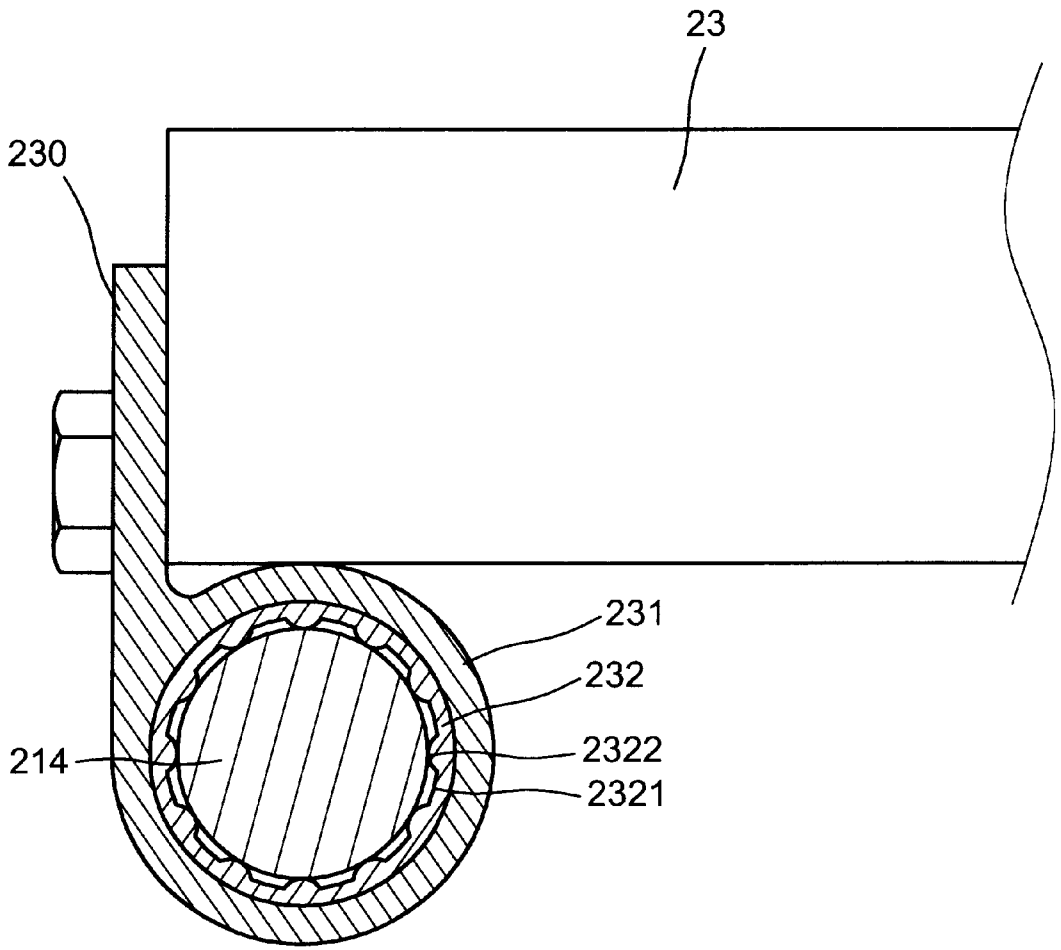
FIG. 7 is a cross-sectional view the sliding plate sleeved on a guide rod.
Figure 8:
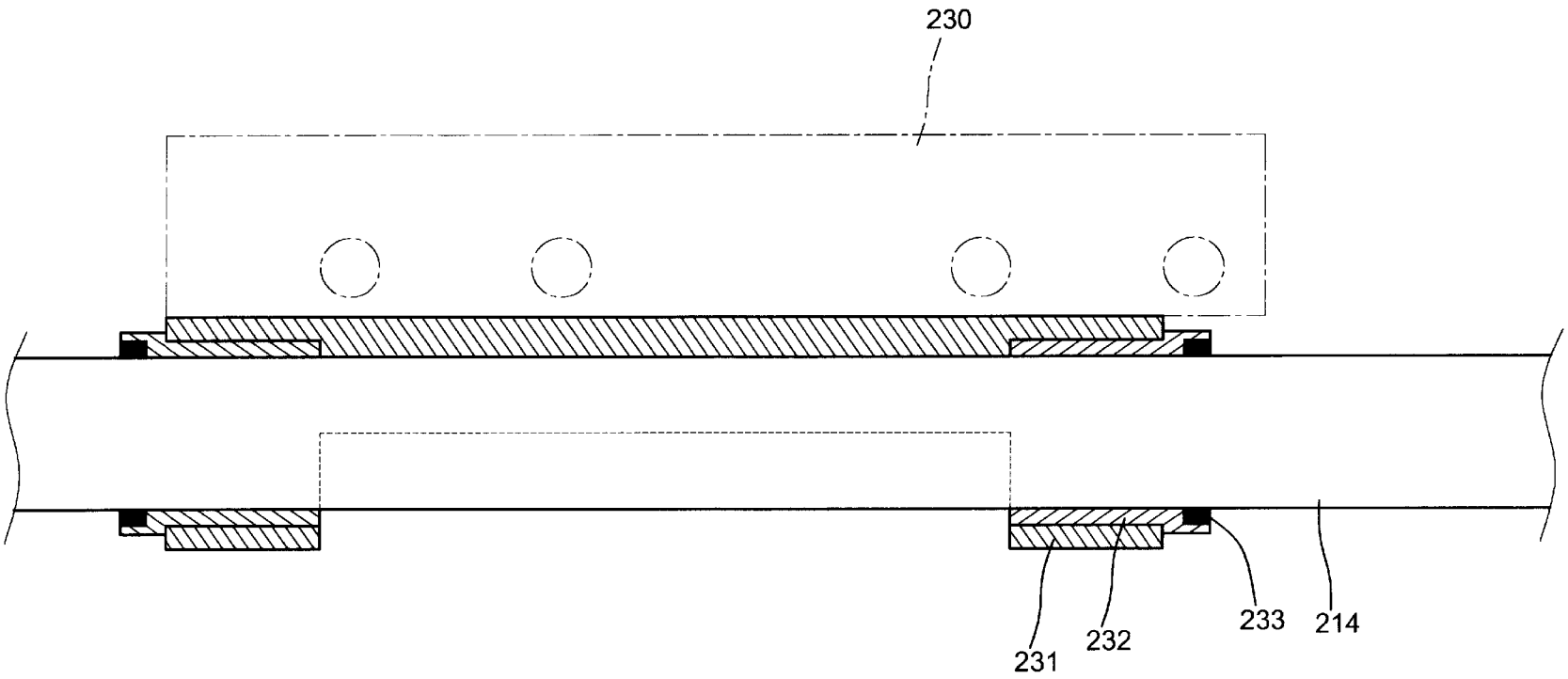
FIG. 8 is a longitudinal section of FIG. 7.

The rectangular platform 23 has a sliding plate 230 secured to one end of the platform 23 and a U-shaped plate 235 secured to the other end of the platform 23 by screws and washers. The sliding plate 230 has a pair annular rings 231 symmetrically formed under two ends slidably sleeved on the guide rod 214 of the frame 21, a pair of annular caps 232 each of which has a plurality of longitudinal stripes on inner periphery to define a plurality of splines 2321 therebewteen (as shown in FIGS. 6, 7 and 8) respectively engaged into the annular rings 231 and a pair of sealing rings 233 respectively secured into the outer end of the annular rings 231. The U-shaped plate 235 has a pair of rollers 234 spacedly projected outward from an outer surface and slidably engaged on the guide rod 215 of the frame 21.

The brace 24 has an inverse U-shaped groove 242 in underside gripped on one end of one of the longitudinal bar 212 of the frame 21 and secured by screws 241 and washers. A positioning plate 28 supported by the brace 24 is adjustably secured to the top of the brace 24 by a lock 281 and a screw 282 with washers thereinbetween.

Figure 9:
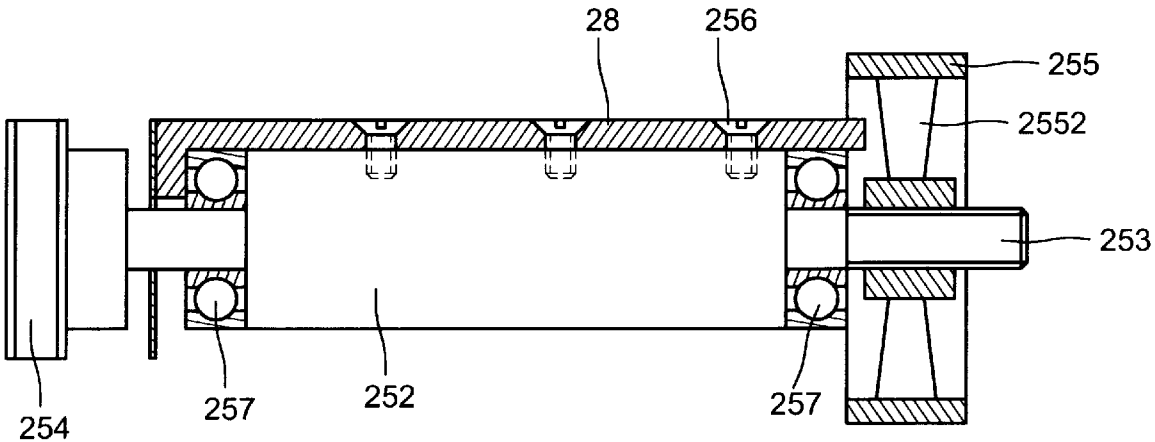
FIG. 9 is a sectional view to show a power transmission shaft secured to a positioning plate.
Figure 10:
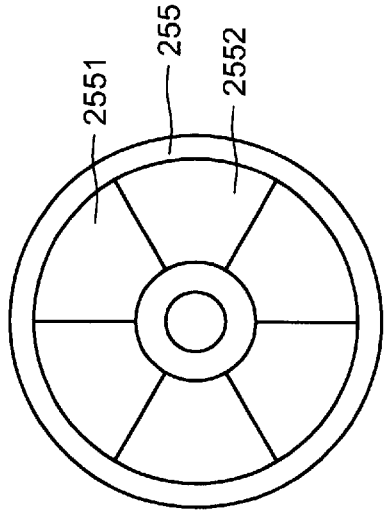
FIG. 10 is a plane view to show a shaft cap in which is a fan.

The motor 25 is fixedly disposed to a top of the positioning plate 28 abutting the outer end thereof and has a switch on the top and a first wheel 250 on the free end of the axis. A tubular shaft 252 is releasably secured under the positioning plate 28 by screws abutting the inner end thereof. A spindle 253 is axially disposed to the center of the tubular shaft 252 and supported by a pair of bearings 257 in two ends of the tubular shaft 252. A second wheel 254 secures to one end of the spindle 253 and a fan cap 255 secures to the other end thereof. The fan cap 255 has a plurality of triangular fan leaves 2551 inside to define a plurality of triangular air vents 2552 therebetween to facilitate the convection of the air (as shown in FIGS. 9 and 10). The saw blade 26 secures to the other end of the spindle 253 by nut and washer positioned abutting the outer surface of the fan cap 255. A belt 251 tensely wraps on the first and second wheels 254 therearound for driving the saw blade 26 to rotate by the motor 25. The blade guard 27 is positioned on the top of the saw blade 26 and secured on outer end to an outer lateral side of the positioning plate 28 opposite to the belt 251. A guide ruler 236 is releasably secured to a flange of the platform 23 positioned on the top therefore (as shown in FIG. 5).

Due to that the pair of the annular rings 235 are spacedly positioned at two ends of the sliding plate 230 and their inner ends are open, so there will be no air sealed in the annular rings 235 to cause an air resistant force inside the annular rings 235. Besides, the stripes 2322 inside the annular caps 232 engage with the outer periphery of the guide rod 214 to reduce the frictional force therebetween, the sliding of the platform 23 on the guide rods 214 and 215 would be more smooth.

Furthermore, the shaft 252 is releasably secured to the positioning plate 28 by screws 256, it is very convenient to disassemble when changes the bearings 257 from inside the shaft 252, and the fan cap 255 facilitates the convection of the air to radiate the heat both in the shaft 252 and the saw blade 26.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A structurally improved stone cutter comprising:

a rectangular frame combined with two pairs of first and second longitudinal bars and a plurality of transverse bars, a pair of gaps defined between said first and second longitudinal bars respectively, four protrudent plates spacedly projected upward from two ends and respectively abutting four corners thereof, a rectangular sink disposed in said frame and a pair of first and second guide rods spacedly and respectively secured their two ends to said protrudent plates by screw and washers;

a rectangular platform slidably disposed on said pair of first and second guide rods of said frame and having a sliding plate secured to one end and a U-shaped plate secured to other end thereof by screws and washers, said sliding plate having a pair of annular rings spacedly formed under two ends thereof slidably wrapped on said first guide rod, a pair of annular caps each of which has a plurality of longitudinal stripes on inner periphery to define a plurality of splines therebetween respectively secured to said pair of annular rings and a sealing ring secured to outer end of said annular caps, said U-shaped plate having a pair of rollers spacedly projected outward from outer surface and slidably engaged on said second guide rod of said frame;

a brace having an inverse U-shaped groove in underside gripped on one end of one of said second longitudinal bar of said frame and secured by screws and washers;

a positioning plate supported by said brace and secured to a top of said brace by a lock and a screw with washers therebetween;

a motor fixedly secured to a top of said positioning plate abutting outer end thereof and having a switch on top and a first wheel on free end of an axis;

a tubular shaft releasably secured under said positioning plate by screws and abutting inner end thereof and having a spindle axially disposed to inside supported by a pair of bearings in two ends thereof;

a second wheel secured to one end of said spindle;

a fan cap secured to other end of said spindle opposite to said second wheel and having a plurality of fan leaves inside to define a plurality of triangular air vents therebetween;

a saw blade secured to said other end of said spindle by nut and washer and positioned abutting outer surface of said fan cap;

a belt tensely wrapped on said first and second wheels therearound;

a belt guard positioned on top of said saw blade and secured on outer end to an outer lateral side of said positioning plate opposite to said belt;

a working station releasably disposed to one of said gaps of said frame and having a L-shaped edge engaged into said gap; and a foldable stand on underside of said frame for supporting said frame.

* * * * *